US005379272A

United States Patent [19]

Parmigiani

[11] Patent Number: 5,379,272

[45] Date of Patent: Jan. 3, 1995

[54] MOSLEM CALENDAR

[76] Inventor: Michel Parmigiani, 14, rue de Buttes, 2114 Fleurier, Switzerland

[21] Appl. No.: 173,661

[22] Filed: Dec. 22, 1993

[30] Foreign Application Priority Data

Jan. 13, 1993 [CH] Switzerland ..... 00078/93

[51] Int. Cl.[6] ..... G04B 19/24

[52] U.S. Cl. ..... 368/37; 368/28

[58] Field of Search ..... 368/34–37, 368/28

[56] References Cited

U.S. PATENT DOCUMENTS 4,253,169 2/1981 Salah .
4,676,659 6/1987 Vuilleumier ..... 368/37
4,766,579 8/1988 Sporrig ..... 368/37

FOREIGN PATENT DOCUMENTS 0154096 10/1983 European Pat. Off. .
660440G 3/1987 Switzerland .

*Primary Examiner*—Bernard Roskoski
*Attorney, Agent, or Firm*—McGlew and Tuttle

[57] ABSTRACT

A first mechanism (2, 5, 8, 18, 20) of the calendar drives a date indicator, bearing numbers 1 to 30, by one one-day step at the end of each day, off a rotary part (1) of an analog timepiece movement. A second mechanism (60, 62) causes the date indicator, in cooperation with the first mechanism, to move forward from the 29th to the 1st of the following month at the end of the even months. A third mechanism (75, 79, 95, 97) inhibits the action of the second mechanism at the end of the embolismic (or abundant) years whereby at the twelfth and final month of these years the date indicator displays 30 before proceeding to the 1st. The calendar is perpetual, and a date-corrector (11) and a month-corrector (54) enable the calendar to be updated.

8 Claims, 10 Drawing Sheets

MOSLEM CALENDAR

BACKGROUND

This invention relates to a mechanical Moslem calendar for an analog timepiece. It relates more particularly to a perpetual Moslem calendar for use in either the movement of a wrist watch or that of a clock.

The Moslem year is based on the moon's cycle and comprises about 354 solar days. The year is divided into 12 months of 29 and 30 days, and into weeks of 7 days of 24 hours. The odd months have 30 days and the even months 29, so that the year starts with a 30-day month and ends with a 29-day month.

In fact, the Moslem year lasts a little longer than 354 days. To compensate this difference, the last month of certain years of a 30-year correction cycle have 30 days instead of 29. Over this 30-year cycle, there are 19 so-called ordinary (or common) years of 354 days each and 11 so-called embolismic (or abundant) years of 355 days each. Actually, two 30-year cycles are used, each cycle being applied to a particular country or region. The two cycles, which start with year 1 and end with year 30, appear in the following table which only shows the embolismic years:

Cycle I: 2, 5, 7, 10, 13, 15, 18, 21, 24, 26 and 29

Cycle II: 2, 5, 7, 10, 13, 16, 18, 21, 24, 26 and 29

The two cycles differ from one another in that in the first the 15th year is an embolismic year and the 16th is an ordinary year whereas it is the other way round in the second.

SUMMARY

An object of the present invention is to provide a Moslem calendar that displays the days of the month while respecting the alternance of the 29-day and 30-day months over a year, and the succession of ordinary years and embolismic years over one or other of the 30-year correction cycles.

To this end, the Moslem calendar provided by the present invention for use in an analog timepiece movement comprises a 30-position date indicator moving forward in one-position steps to successively display numbers 1, 2, . . . 29, 30, 1, 2, . . . , and is mainly characterized in that it comprises:

- a first mechanism for driving, off a rotary part of the movement, at the end of each day, the date indicator by one step;
- a second mechanism, cooperating with the first, for driving, at the end of the even months, the date indicator by two successive steps to cause it to move from the 29th to the 1st of the following month in a short space of time; and
- a third mechanism, cooperating with the other two, for temporarily neutralizing the action of the second mechanism at the end of the embolismic years defined by a 30-year correction cycle, whereby the date indicator will display 30 on the last day of the twelfth and final month of these years.

Other features and advantages of the invention will become apparent from the following explanatory description of one possible embodiment of such a calendar, with reference to the accompanying drawings.

DRAWINGS

In the drawings, in which the same references relate to similar elements:

Figure 2:
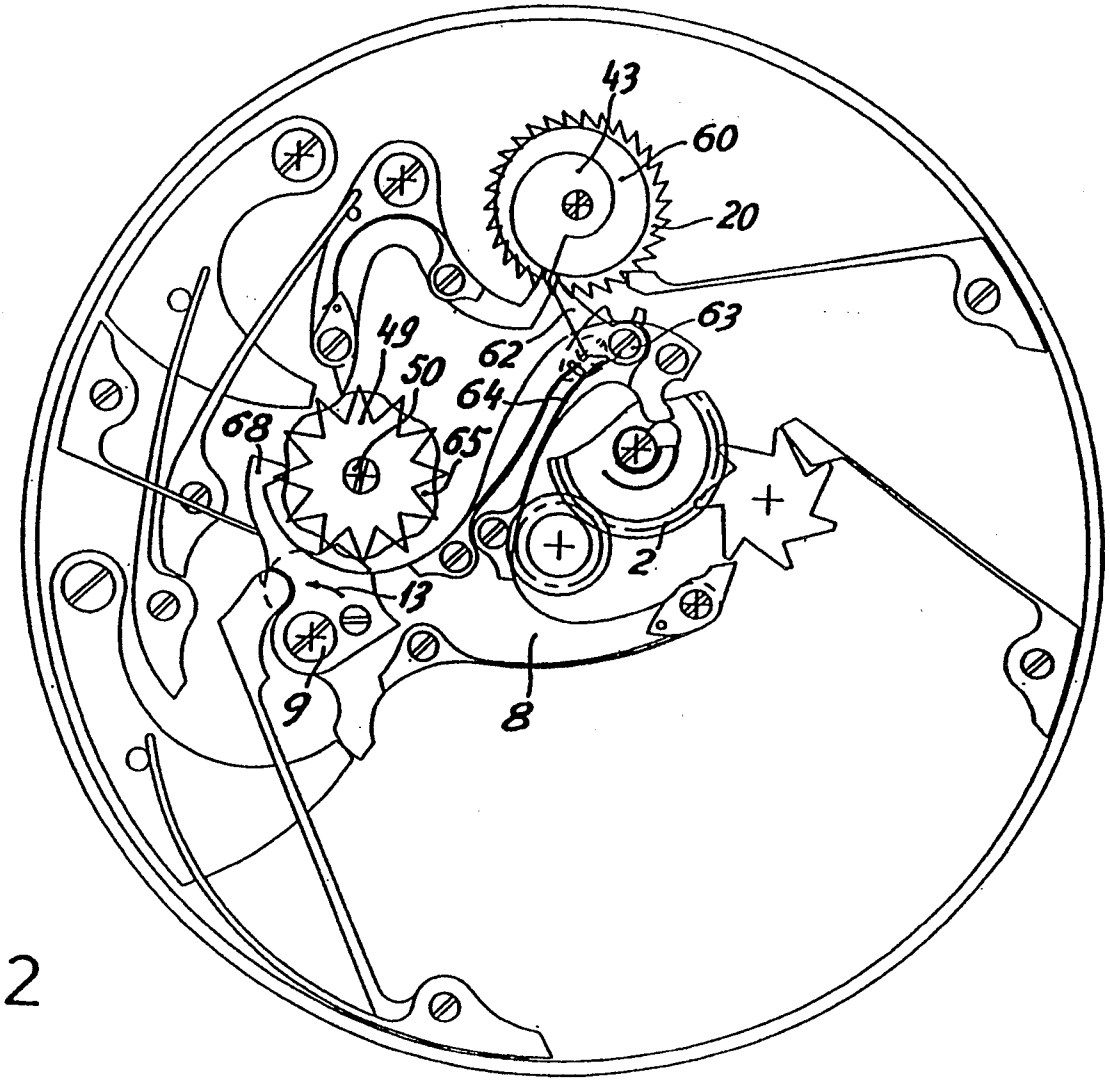
FIG. 2 shows, in addition to the part of the calendar that is illustrated in FIG. 1, the part that serves to drive the date indicator by two consecutive steps at the end of the even months.
Figure 2A:
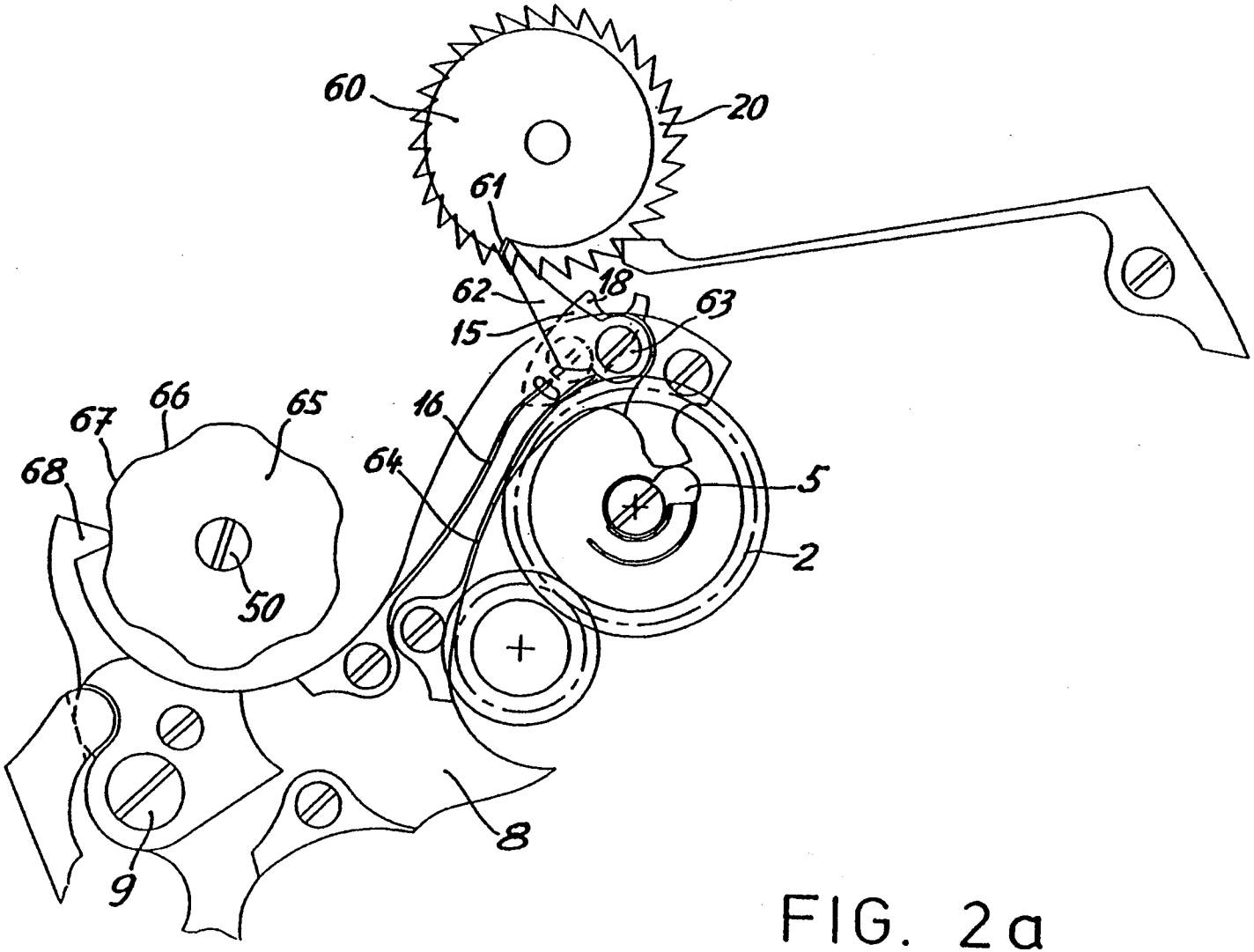
Figure 2B:
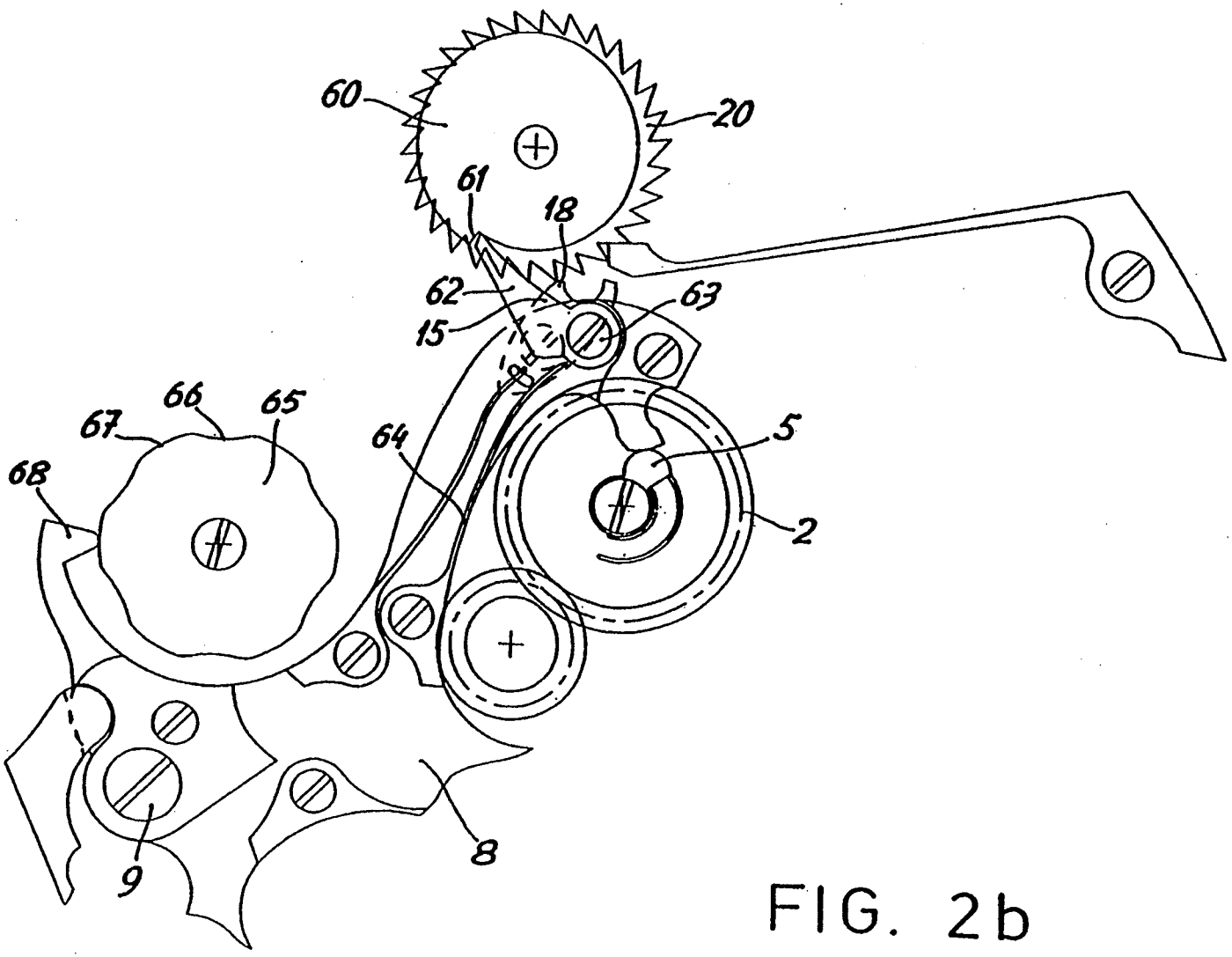
Figure 3:
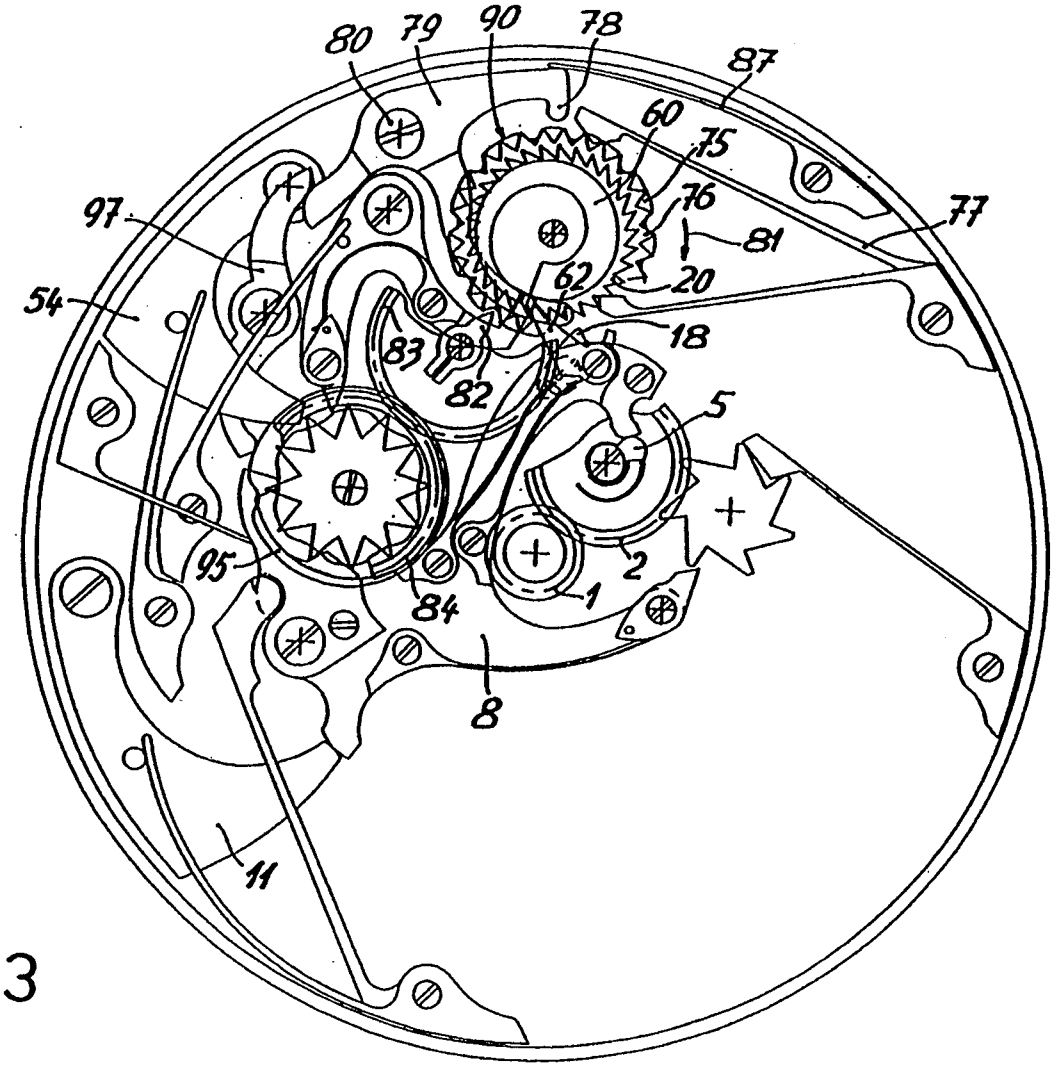
Figure 3A:
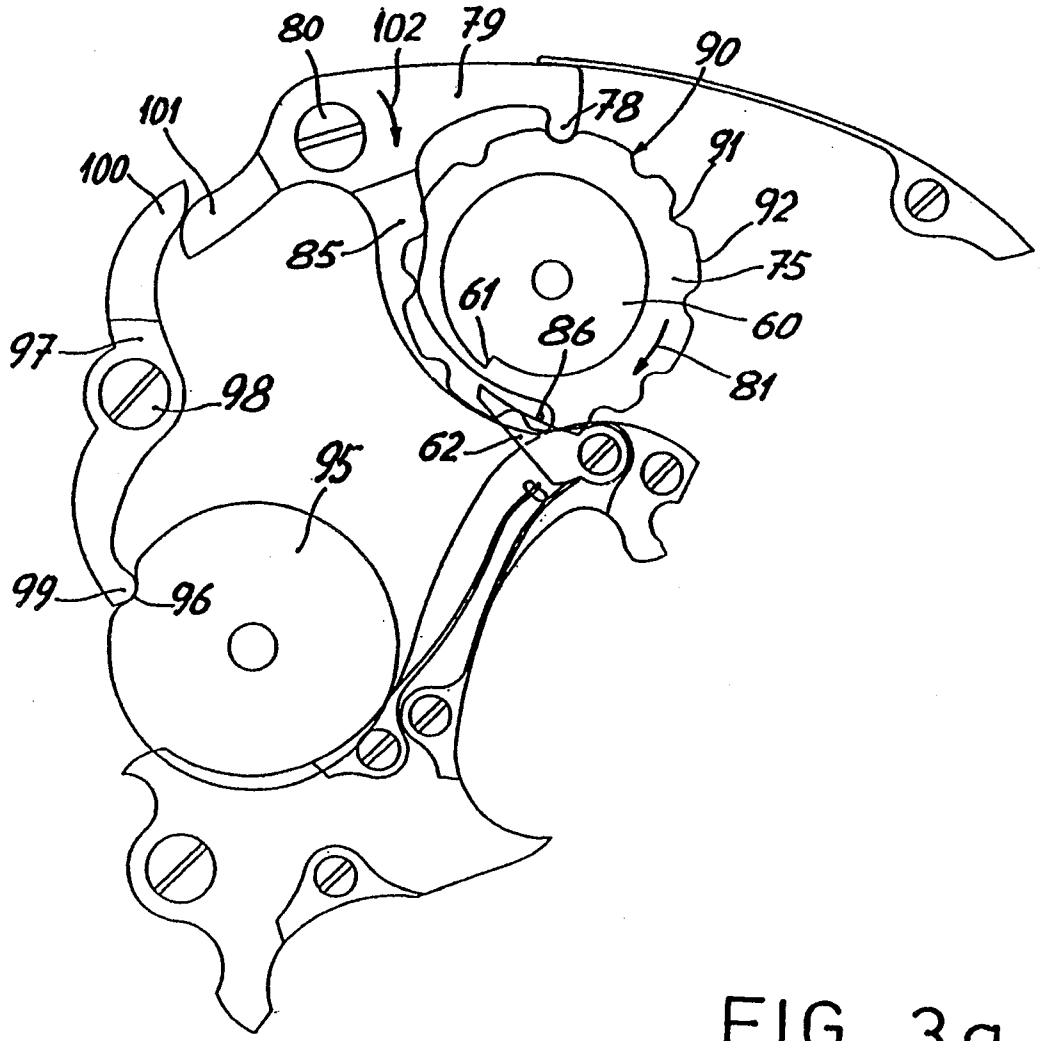
Figure 3B:
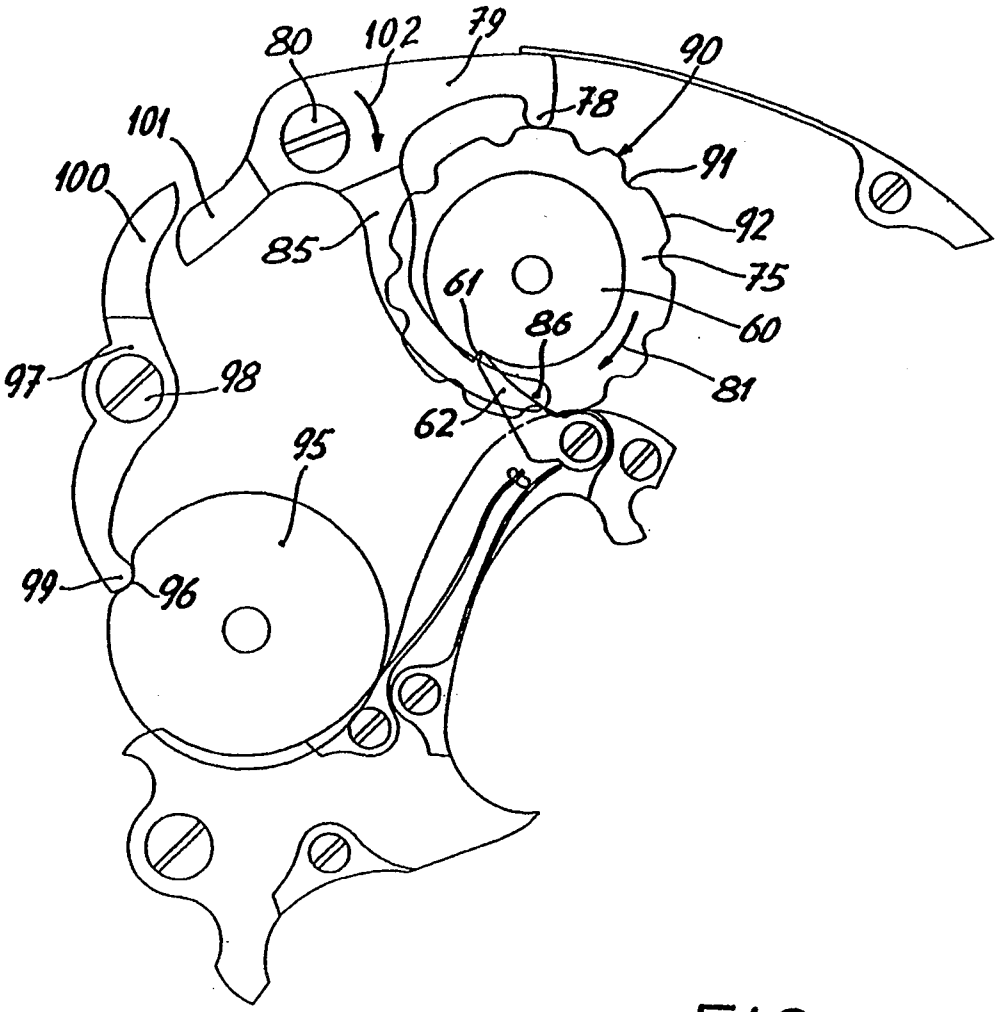
Figure 3C:
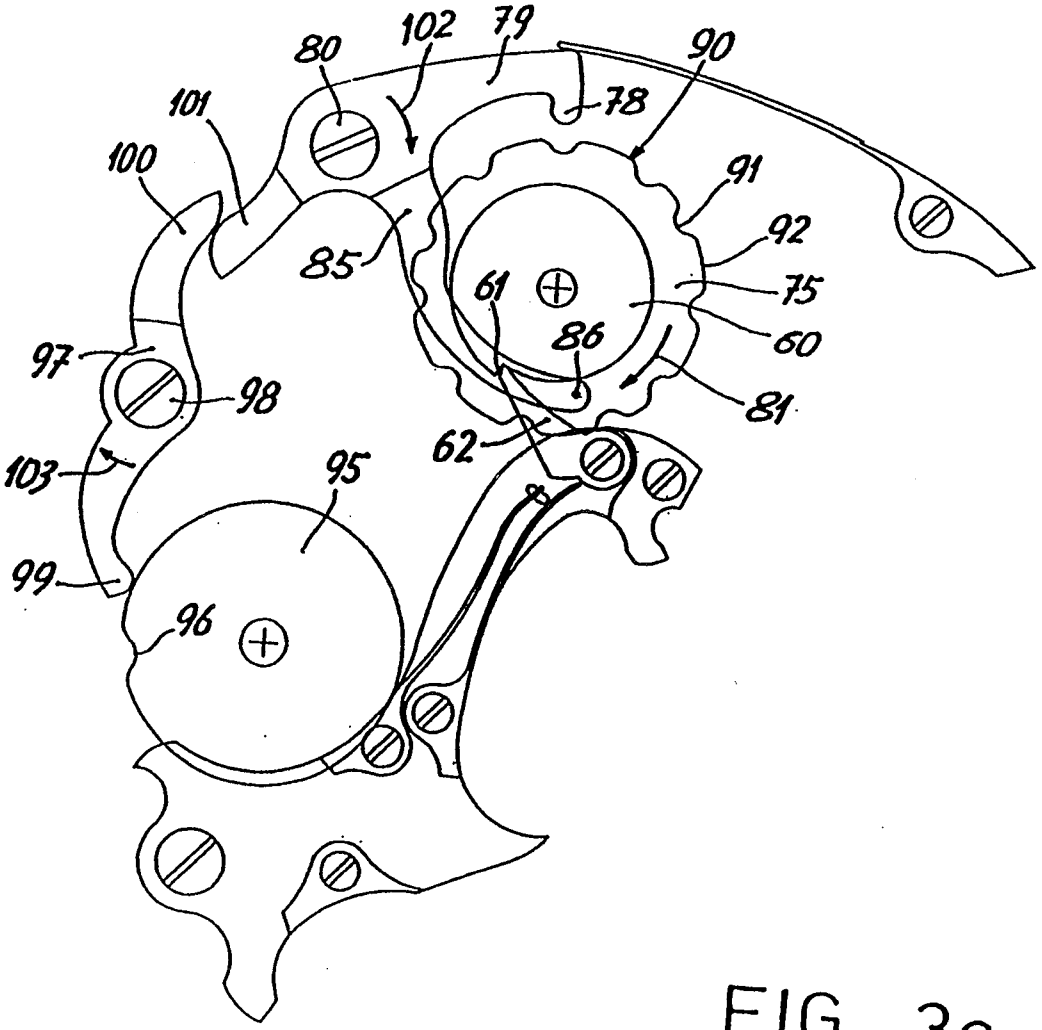
Figure 4:
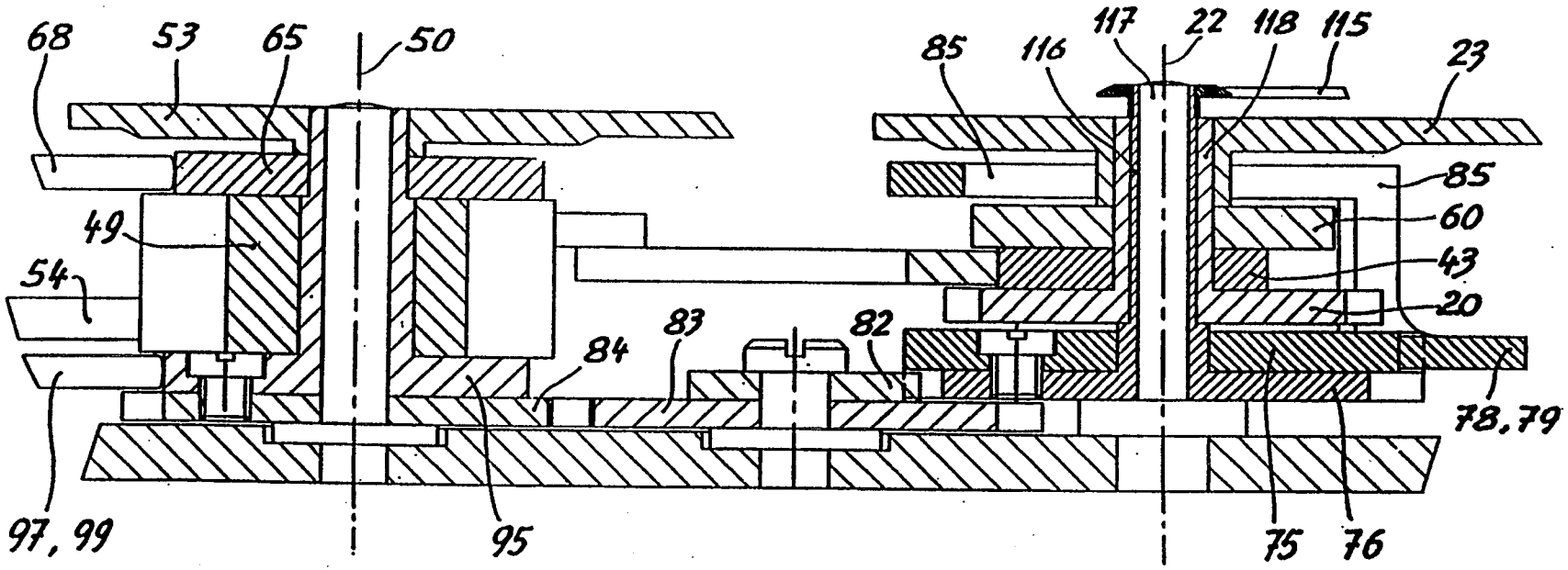
Figure 6:
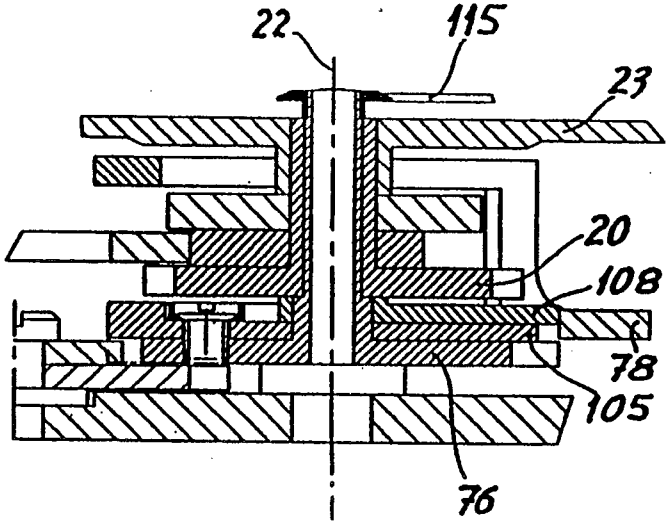
Figure 5:
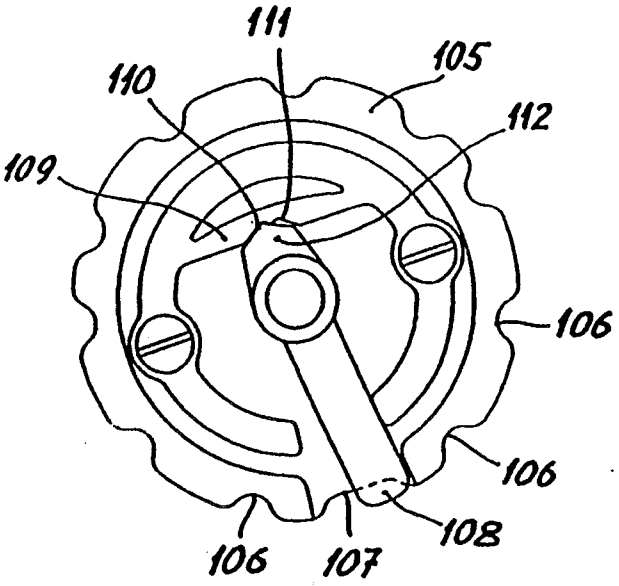

FIGS. 2*a* and 2*b* are partial views showing the operation of the calendar's components that enable the date indicator to move by two consecutive steps;

FIG. 3 is a complete view of the perpetual calendar;

FIGS. 3*a*, 3*b* and 3*c* are partial views, respectively at the end of an embolismic year, at the end of an ordinary year and in the course of an embolismic year, of the calendar's components that operate in accordance with one or other of the 30-year cycles defining the succession of the ordinary and embolismic years;

FIG. 4 is a cross-sectional view of the calendar, in a plane passing through the staffs carrying the date indicator and the month indicator;

FIG. 5 shows in plan a universal cam for achieving correction cycle I or correction cycle II; and FIG. 6 is a cross-sectional view passing through the axis of the date indicator and showing the universal cam.

DESCRIPTION

The calendar according to the invention will be described in the case where it forms part of an analog movement for a wristwatch, mechanical or electronic, but it can of course be used to advantage in any analog timepiece.

Figure 1:
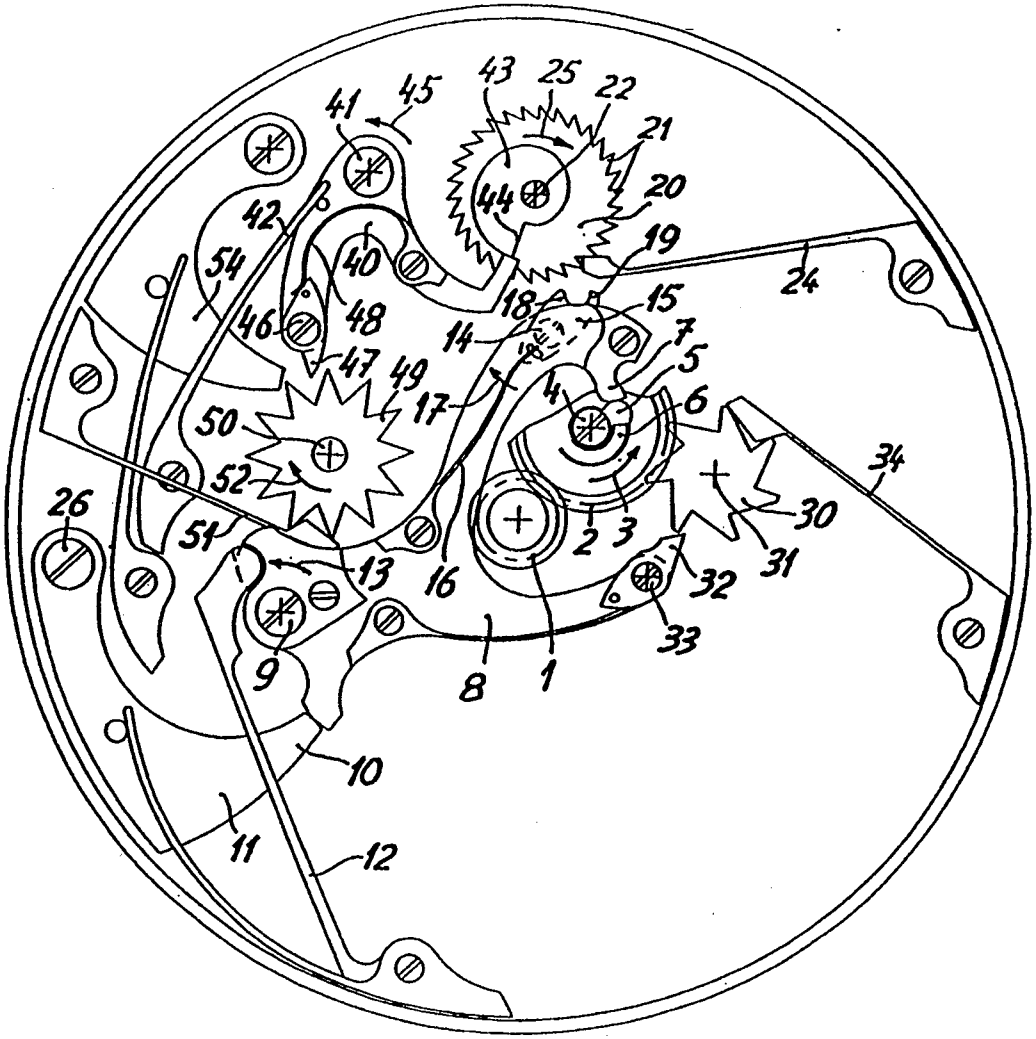
FIG. 1 illustrates, in plan, the part of a perpetual calendar according to the invention that serves to drive each day the date indicator forward by one step.

In FIG. 1 are shown, in plan from above the watch movement, the components of the calendar mechanism that cause the date indicator to move forward by one step at the end of each day.

Reference 1 designates in this figure a rotary part with a pinion that is solid with the hour-staff of the movement. The pinion meshes with a toothed wheel 2 of the calendar so as to perform one complete revolution every 24 hours in the direction of arrow 3. A first drive means includes, a wheel 2 and a catch 5. Wheel 2 pivots on a staff 4 on which also rotates freely catch 5. A projecting tongue of wheel 2 drives catch 5 when the wheel rotates in the direction of arrow 3 and passes under the catch without driving it when the wheel rotates in the opposite direction, in the course of a time-correcting operation of the watch. Catch 5, during part of its rotation, engages a beak 7 solid with a first, or main, lever 8 pivoting about a staff axis 9 of the movement. The lever is kept in a rest position, where it bears against a projecting portion 10 of a pivoting hammer or day correction means 11, by a return spring 12. Under the action of catch 5, lever 8, shown in FIG. 1 just at the start of its movement, rotates in the direction of arrow 13 against the action of spring 12. A second drive means includes a click 15, a beak 18, and a beak 19. The click 15 pivots through an angle limited by abutments on a pin 14 solid with lever 8. The click is held by a spring 16 in a position in which it has rotated to the maximum angular extent in the direction of arrow 17, and, at one end, it has two beaks 18 and 19.

A date-star 20, having thirty teeth 21 and pivotally mounted on the movement near click 15 on a pin or date star axis 22, further carries a date indicator in the form of a disc 23, visible in FIG. 4, bearing numbers 1 to 30 that appear successively behind a window in a dial not shown. A jumper 24, engaging teeth 21, positions the star while enabling it to move forward in one-tooth steps in the direction of arrow 25 to perform a complete revolution in one month.

Lever 8, in its rotation in the direction of arrow 13 resulting from the action of catch 5 at the end of a day, causes beak 18 of click 15 to engage a tooth 21, so as then progressively to drive star 20 forward one step in the direction of arrow 25 and at the same time causing the date to change to that of the next day. With beak 7 having got past the tip of catch 5, lever 8 starts moving back under the action of spring 12. Beak 18 then slides on the tooth of star 20 causing click 15 to pivot, thereby locating beak 19 opposite an adjacent tooth. In this position, beak 19 acts as a safety stop that prevents star 20 from rotating inadvertently while lever 8 is being pivoted during a forward manual operation.

The above mechanism or day driving means described so far constitutes a simple calendar since the months it displays all have thirty days. To have an exact indication of the dates, the date indicator must be moved forward manually by one day at the end of the even months except at the end of the twelfth and final month of the embolismic years. This is done in known manner by pressing a push-button, not shown, associated with the hammer 11 mentioned earlier. In response to this action, hammer 11 pivots about a pin 26 and its projecting portion 10 then moves lever 8, in the same manner as catch 5, to cause star 20 to rotate by one step.

FIG. 1 further shows a day indicator and a month indicator. The day indicator, of conventional design, includes a day disc, not shown, that is solid with a day-star 30 pivotally mounted at 31 and having seven teeth. Star 30 is moved by one, one-tooth, step every 24 hours, like star 20, by a click 32 that pivots through a limited angle on a pin 33 fixedly mounted on lever 8. A jumper 34 angularly positions star 30, whereas the day indicator may be updated independently of the date indicator, by means of a push-button operated correcting device not shown. In a perpetual calendar such a correcting device is however superfluous, since no shifting will occur in the course of time between the days and the dates which are factory set once and for all.

The month indicator is driven at the end of each month by a second lever 40 pivotally mounted on a pin or second lever axis 41 of the movement. One end of the lever bears, under the action of a spring or elastic element 42, on a first snail-shaped cam 43. This cam is solid with date-star 20 and has an abrupt flank 44. Lever 40 and flank 44 are so arranged in relation to one another that on the 30th day the lever abruptly swings in the direction of arrow 45, its end then travelling over the abrupt flank. At the other end of lever 40 is fixedly provided a pin 46 on which is mounted a click or third drive means 47 for pivotal movement through an angle limited by abutments, a spring 48 moving it into the position to which it has rotated by a maximum angular extent in a direction opposite to that of arrow 45. Opposite click 47 is located a month-star 49 having twelve teeth. Star 49, which is pivotally mounted on a pin or month star axis 50 of the movement, is angularly positioned by a jumper 51. At the end of each month, when lever 40 performs an instantaneous jump in the direction of arrow 45, click 47 engages the teeth of star 49 to move it, instantaneously also, by a one-tooth step in the direction of arrow 52, and cause it to complete a full revolution in one year. The month indicator is a disc 53, shown in FIG. 4, that is solid with star 49 and carries the 12 months of the year, which travel one after another behind a window in the dial not shown. A hammer or month correction means 54, controlled by a push-button, not shown, enables the month-star to be moved forward independently of the date-star.

The progressive but rapid switch of the calendar from the 29th to the 1st of the following month at the end of each even month, while at the same time causing day-star 30 to move forward only one step, is achieved with a mechanism whose components are shown in FIGS. 2, 2*a*, 2*b* and 4. A second snail-shaped cam 60, similar to cam 43 and having an abrupt flank 61, is so located on cam 43 as to be solid with date-star 20. The end of a click or fourth drive means 62, pivotally mounted on a pin 63 fixedly mounted on lever 8, is urged into engagement with cam 60 by a spring 64. The position of the cam's flank 61 in relation to the teeth 21 of star 20, the length of click 62, and the pivotal angle of lever 8 are so arranged that at the end of the 29th day of a month, when lever 8 starts rotating in the direction of arrow 13, click 62, upon engaging flank 61, first causes star 20 to move a first step (FIG. 2*a*). With lever 8 continuing to rotate, the beak 18 of click 15 then engages a tooth of star 20, while click 62 is still bearing on flank 61. During the final stage of the pivotal movement of lever 8, beak 18 and click 62 thus act in the same direction on star 20 to cause it to move forward a second step. By virtue of click 62, the pivotal movement of lever 8 has thus caused star 20 to be rotated through two consecutive steps, and caused the date indicator to have switched from the 29th to the 1st of the following month in a short space of time, while day-star 30 has moved forward by only one step under the action of click 32. Of course at times other than the last day of a month, flank 61 is out of reach for click 62 and it is beak 18 that drives star 20 by a single step.

According to the Moslem calendar, date-star 20 must however only move forward through two consecutive steps on even months. In order for the odd months to retain 30 days, a third circular month-cam 65, pivotally mounted on pin 50 and having six dips 66 and six humps 67, is fixedly mounted on month-star 49.

A beak 68, forming part of an arm that is solid with lever 8, bears on cam 65. When beak 68 is located in a dip 66, the pivotal angle of lever 8 is normal, and when beak 68 is on a hump 67 this angle is reduced. Cam 65 is so keyed on star 49 that beak 68 will be in a dip 66 at the end of the even months (FIG. 2*a*), whereby date-star 20 will carry out two consecutive steps as already described, and on a hump at the end of the odd months (FIG. 2*b*). The reduced pivotal angle of lever 8, when beak 68 is on a hump 67, is so set that click 62 and beak 18 cause star 20 to move forward by one step only, and hence to move the date indicator from the 30th to the 1st of the following month, this forward motion corresponding to the second step at the end of the even months.

With this automatic jump by the date indicator from the 29th to the 1st of the following month at the end of the even months, the mechanism as described so far constitutes a semi-perpetual calendar that correctly indicates all dates except those at the end of the twelfth month of the embolismic years, as the last month of these years has 30 days and not 29 like the other even months. One extra day must therefore be added to the last month of the embolismic years, i.e. the date indicator must therefore be moved back from the 1st of the new year to the 30th of the preceding month. In the present mechanism, it is not possible to do this with hammer 11 and its push-button since the date indicator can only be moved forward. In order to display the exact date until the next embolismic year, the date indicator, when it displays for instance the 2nd, must, in these conditions, be moved forward manually until the 1st of the following first odd month, i.e. by two months.

This operation is a drawback that the invention overcomes with a mechanism, or embolism year means, that will automatically neutralize, at the end of the embolismic years, the action of the previously described mechanism, or month driving means, that enables, at the end of the even months and by means of click 62, the date indicator to jump from the 29th to the 1st of the following month.

FIGS. 3 and 4 show all of the components of the calendar mechanism being described, and FIGS. 3*a*, 3*b* and 3*c* show more particularly the parts, at various stages of their movements, that act on click 62 to inhibit its action. A fifth drive means includes star 76, jumper 77, finger 82, toothed wheel 83, and toothed wheel 84. In these figures, reference 75 designates a year-cam or fourth cam of circular shape that freely pivots on pin 22 and on which is fixedly mounted star 76 having thirty teeth. The jumper 77, bearing on the teeth of star 76, angularly positions cam 75 opposite which is located a beak or projecting portion 78 forming part of the end of an inhibiting or third lever 79 pivotally mounted on a pin or third lever axis 80 of the movement. Cam 75 is rotatably driven, in the direction of arrow 81 at the rate of one revolution in thirty years, by finger 82 that performs one revolution per year and which engages the 30-tooth toothing of star 76. Finger 82 is fixedly mounted on toothed wheel 83 that meshes with a toothed wheel 84 which is solid with month-star 49 and which has the same number of teeth as wheel 83. Since star 49 moves forward in instantaneous steps, the same applies to cam 75 which thus performs instantaneous jumps of single one-year steps.

Lever 79 further has an arm 85 to the end of which is secured a pin 86 which, depending on the position of the lever, engages or disengages click 62. Additionally, a return spring or another elastic element 87 exerts a force on lever 79 in a direction urging beak 78 towards cam 75.

In the present embodiment, cam 75 and star 76 pivot on pin 22, which pin already carries star 20. Of course another arrangement could have been adopted wherein cam 75 and star 76 would rotate on a pin other than 22, the only condition having to be satisfied being that cam 75 engages the beak 78 of lever 79, with the shape of the cam being suitably modified. Finger 82 and toothed wheel 83 are only intermediate transmission components, made necessary in the present case by the remoteness of pins 22 and 50. Clearly, in another arrangement, star 76 could have been driven directly by a finger of star 49, or off another rotary part of the movement via a suitable gear-train.

Cam 75 has a profile 90 of varying radius. This profile is representative of the 30-year correction cycle mentioned earlier and differs slightly for cycle I and cycle II. In the present case, profile 90 has eleven notches 91 corresponding to the eleven embolismic years and a protruding portion corresponding to each ordinary year, these protruding portions together forming eleven separate sectors 92 of constant radius.

The pivotal motions of lever 79 are controlled by a fifth cam 95 secured on month-star 49 and by an intermediate or fourth lever 97 that is pivotally mounted at its middle on a pin, or fourth lever axis 98. One end, 99, of lever 97 engages cam 95, whose circular profile includes a notch 96, whereas the other end 100 of lever 97 lies opposite another arm 101 of lever 79.

FIG. 3*a* represents the position of the mechanism's components when the calendar indicates the end of an embolismic year. The cams 75 and 95 are so keyed angularly that beak 78 will penetrate one of the notches 91 and the end 99 of lever 97 will penetrate notch 96. Lever 79 will then have pivoted to the maximum angular extent in the direction of arrow 102, under the action of spring 87, to bring the end 100 of lever 97 just in contact with arm 101, without exerting any pressure thereon. The arm 85 of lever 79 occupies, under these conditions, a position such that pin, or control element 86 moves the tip of click 62 away from cam 60 by an angle sufficient for it not to be able to act on the abrupt flank 61. Click 62 being thus neutralized at the end of the twelfth and final month of an embolismic year, the date indicator will display 30 before moving on to the 1st of the first month of the following year as a result of the action, already described, of beak 18 on star 20.

At the end of an ordinary year, as shown in FIG. 3*b*, beak 78 comes to bear on a sector 92 of cam 75, while the end 99 of lever 97 is located, as before, in notch 96. Lever 79 then occupies an angular position in which the end 100 of lever 97 is moved away from arm 101 and pin 86 is no longer in contact with click 62. No hindrance being applied to the click, the latter may accomplish its function normally by engaging flank 61 to rotate cam 60 through two consecutive steps in the manner described earlier.

In the course of a year, whether ordinary or embolismic, the end 99 of lever 97 bears however on the circular portion of cam 95, outside notch 96, causing lever 97 to pivot in the direction of arrow 103. The other or another end 100 of lever 97 then engages arm 101 of lever 79 to cause the latter to pivot in a direction, opposite to arrow 102, that will move beak 78 away from cam 75 and pin 86 away from click 62. This position of the calendar's components is shown in FIG. 3*c* in the case of an embolismic year as beak 78 is located opposite one of notches 91. In the case of an ordinary year, beak 78 would however be located opposite one of the sectors 92, but without engaging the latter. Pin 86 being spaced from click 62, the latter is therefore able to accomplish its function, both during ordinary and embolismic years.

It can also be said, in an equivalent manner, that by virtue of cam 95 and lever 97, whose end 99 is located in notch 96, lever 79 performs a rotary motion at the end of each year, in the direction of arrow 102, causing beak 78 to engage cam 75. If the beak touches one of the sectors 92, it is an ordinary year and click 62 moves the date indicator through two days, i.e. from the 29th to the 1st. But if the beak enters one of the notches 91, it is an embolismic year and the click is then temporarily neutralized so that the date indicator is only moved by one day, from the 30th to the 1st, by beak 18. In the course of a year, with the end 99 of lever 97 being located outside notch 96, click 62 operates normally at the end of the even months by moving the date indicator from the 29th to the 1st.

The above-described mechanism being in conformity with the succession of ordinary and embolismic years occurring in one of the 30-year cycles, it constitutes a perpetual Moslem calendar. For each cycle there is a particular year-cam 75. To change the cycle, it is therefore necessary to replace the cam, which is thus removably mounted. Although not particularly difficult, this replacement needs to be done by a specialist, to whom the new cam must be supplied. To avoid the loss of the cam that is not in use, the two cams could both be present in the calendar's mechanism, e.g. one on top of the other on pin 22. The cycle could be selected by vertically moving lever 79 that is slidably mounted on pin 80 to enable beak 78 to engage the required cam. This movement could possibly be made by the wearer of the watch by external control means.

Another way consists in using, instead of year-cam 75, a universal cam having a profile that can be modified at will to suit one or other of correction cycles I and II. One possible cam, referenced 105, is shown in plan in FIG. 5. The cam's profile is circular, has the same diameter as cam 75 and has ten notches 106 plus a double notch 107. Notches 106 are arranged to correspond to the ten embolismic years 2, 5, 7, 10, 13, 18, 21, 24, 26 and 29 that are to be found in both correction cycles I and II, whereas the wider notch 107 spans the years 15 and 16 of these two cycles, their first year being noted 1 and their last year being noted 30. A finger rocking 108 having a length equal to the diameter of the cam and which pivots about the center of the latter, is so arranged that its tip, which has a width equal to that of a notch 106, may fill the portion of double notch 107 corresponding to the year 15, or to the year 16. When finger 108 is thus positioned on the year 16, the profile of cam 105 is in conformity with cycle I, or with cycle II when the finger is positioned on the year 15.

To switch from one cycle to the other, it thus suffices to move finger 108 with a pointed tool from one position to the other, in each of which it is held by an elastic arm 109. Arm 109 has to this end two notches 110 and 111 into either of which a protruding portion 112 that is solid with finger 108 may alternately fit. FIG. 6 further shows the position of cam 105 in the calendar mechanism, with beak 78 engaging either cam 105 or finger 108.

A date-corrector and a month-corrector are enough to date set the calendar, a day-corrector being superfluous in a perpetual calendar as has already been noted. For a complete date-setting, a 30-year correction cycle indicator must however also give the position of the year cam, 75 or 105. This is done, in the present embodiment, by a year-needle 115, shown in FIGS. 4 and 6, that is solid with year cam 75, 105 and which pivots about axis 22 before a dial not shown bearing the succession of the ordinary and embolismic years over a 30-year period. Needle 115 is driven on to a pipe 116 forming part of star 76, the resulting assembly being rotatably mounted on an arbor 117, along axis 22, fixedly mounted on the movement. The year-cam 75, 105 is also driven on to pipe 116, while star 20 is free to pivot on pipe 116 along with the rotary parts 23, 43 and 60 mentioned earlier and which star 20 carries by means of a pipe 118.

Clearly, the above-described calendar may still be modified in ways other than those already mentioned and be produced in a variety of constructional forms that will be obvious to the man of the art within the context of the present invention.

I claim:

1. A Moslem calendar comprising:

an analog timepiece movement including a rotary part;

a date indicator displaying dates 1 through 30 in thirty consecutive positions;

day driving means driven by said rotary part of said analog timepiece movement and for consecutively moving said date indicator to a next of said thirty consecutive positions at an end of each day;

month driving means driven by said day driving means and for moving said date indicator by two of said thirty consecutive positions at an end of even months, said month driving means moving said date indicator from displaying 29 to displaying 1 at said end of said even months;

embolism year means driven by said day driving means and said month driving means, and for only blocking said month driving means from moving said date indicator by said two of said thirty consecutive positions at an end of embolismic years defined by a 30-year correction cycle, said embolismic year means causing said date indicator to display 30 on a last day of a twelfth month of the Moslem calendar during said embolismic years.

2. A calendar according to claim 1, wherein:

said day driving means includes:

a first lever mounted for pivotal motion about a staff axis through a set angle and said first lever is maintained in an initial position by an elastic element;

first drive means interacting with said rotary part of said analog timepiece movement for moving said first lever through a set angle at the end of each day;

a date-star mounted for pivotal motion about a date star axis and having thirty teeth;

second drive means disposed on said first lever, and for causing said date-star to pivot by one, one-tooth, step at the end of each day; and a display element solid with said date-star and forming part of said date indicator.

3. A calendar according to claim 2, wherein:

said month driving means includes:

a first, snail-shaped, cam solid with said date-star and having an abrupt flank;

a second lever mounted for pivotal motion about a second lever axis and bearing by one end on said first snail-shaped cam under an action of pressure exerted by an elastic element, said second lever carrying out an abrupt rotational movement through a set angle at the end of each month, when said end of said second lever moves over said abrupt flank;

a month-star mounted for pivotal motion on a month star axis and having twelve teeth;

third drive means disposed at another end of the second lever, for abruptly pivoting the month-star by one, one-tooth, step at the end of each month;

a second, snail-shaped, cam, solid with the date star and having an abrupt flank;

fourth drive means disposed on the first lever, for moving forward, in cooperation with said second drive means, at the end of each month with the aid of said abrupt flank of the second snail-shaped cam during pivotal motion of the first lever, the date-star by two consecutive steps and the date display element from the 29th to the 1st of the following month;

a third, circular, cam solid with the month-star and having six dips regularly distributed over the circumstance, said third circular cam acting as a bearing for a projecting portion of the first lever and being so arranged that, at the end of even months, said projecting portion is located in one of said dips and said first lever will pivot through said set angle and the display element shows 29 before moving on to showing 1, and at the end of the odd months, said projecting portion is located outside said dips causing the first lever will pivot through a lesser angle and the display elements shows 30 before moving on to the 1.

4. A calendar according to claim 3, wherein:

said embolismic year means includes:

a fourth, circular, cam positioned to perform one complete revolution in thirty years and having eleven notches distributed over the circumference, each notch corresponding to said embolismic year of said 30-year correction cycle;

fifth drive means for abruptly causing said cam to pivot through one, one-year, step at the end of each year;

a third lever mounted for pivotal motion about a third lever axis and having a projection portion, urged into engagement with the fourth cam by another elastic element, and a control element cooperating with said fourth drive means, the third lever being so arranged that the projecting portion will penetrate, at the end of the embolismic years, into one of a plurality of notches in said fourth cam and cause the control element to neutralize the action of said fourth drive means, and, at the end of the ordinary years, said projecting portion will engage the fourth cam outside said notches causing the control element, after a pivotal motion of the lever, to enable said fourth drive means to act on said second cam;

a fifth, circular, cam solid with the month-star and having a notch on its circumference; and a fourth lever mounted for pivotal motion about a fourth lever axis and having two ends, one end of said fourth lever bearing against the fifth cam, and being arranged to penetrate the notch in said fifth cam at the end of each year and another end of said fourth lever being disposed opposite an arm of the third lever, the fourth lever being arranged that when said one end is in said notch of said fifth cam, said another end lies outside a trajectory of said arm of said third lever, and when said one end of said fourth lever is out of said notch of said fifth cam during an ordinary or embolismic year, the another end moves the third lever through an angle to put said control element out of reach of said fourth drive means.

5. A calendar according to claim 4, further comprising:

a day indicator including a day-display element solid with a day-star cooperatively associated with said first lever;

an ordinary year and embolismic year indicator including a year-display element solid with said fourth cam.

6. A calendar according to claim 5, further comprising:

month correction means for correcting said month indicator.

7. A calendar according to one of claims 2–6, and 1, further comprising:

day correction means for correcting said date indicator.

8. A calendar according to claim 4, wherein:

said fourth cam is a universal cam having:

ten notches distributed over a circumference of said fourth cam and identifying with years 2, 5, 7, 10, 13, 18, 21, 24, 26 and 29 corresponding to the embolismic years of two 30-year correction cycles of which a first year is identified as 1 and a last year as 30, and a double notch spanning years 15 and 16 corresponding respectively to an embolismic year and to an ordinary year of the first correction cycle and to an ordinary year and to an embolismic year of the second cycle; and a rocking finger moveable between first and second positions having an end portion with a width substantially equal to that of a notch of said ten notches of said universal cam, said end portion when in the first position of said rocking finger obliterating a portion of said double notch corresponding to the year 16 to define a cam suitable for said first correction cycle, and when in the second position of said rocking finger obliterating a portion of said double notch corresponding to the year 15 to define a cam suitable for said second cycle.

* * * * *